US006131382A

United States Patent [19]

Dinkelmann et al.

[11] Patent Number: 6,131,382

[45] Date of Patent: Oct. 17, 2000

[54] METHOD OF AND APPARATUS FOR MAKING A MOCK YARN

[75] Inventors: Friedrich Dinkelmann, Rechberghausen; Andreas Olbrich, Kirchheim, both of Germany

[73] Assignee: Zinser Textilmaschinen GmbH, Ebersbach/Fils, Germany

[21] Appl. No.: 09/285,434

[22] Filed: Apr. 2, 1999

[30] Foreign Application Priority Data

Apr. 3, 1998 [DE] Germany ..... 198 15 053

[51] Int. Cl.[7] ..... D01M 5/28

[52] U.S. Cl. ..... 57/315; 57/6; 57/75; 57/76; 57/328

[58] Field of Search ..... 57/6, 75, 76, 315, 57/328; 19/246, 286, 287

[56] References Cited

U.S. PATENT DOCUMENTS

| | | | |
|---|---|---|---|
| 4,584,830 | 4/1986 | Faure et al. | 57/328 |
| 4,658,574 | 4/1987 | Vignon | 57/328 |
| 4,757,680 | 7/1988 | Berger et al. | 57/6 |
| 4,953,349 | 9/1990 | Fehrer | 57/315 |
| 5,090,192 | 2/1992 | Stahlecker | 57/315 |
| 5,167,114 | 12/1992 | Stahlecker | 57/328 |
| 5,228,281 | 7/1993 | Stahlecker | 57/328 |
| 5,243,813 | 9/1993 | Stahlecker | 57/315 |
| 5,285,624 | 2/1994 | Stahlecker | 57/328 |

FOREIGN PATENT DOCUMENTS

| | | |
|---|---|---|
| 0 635 590 | 1/1995 | European Pat. Off. . |
| 882 066 | 7/1953 | Germany . |
| 39 27 739 | 2/1991 | Germany . |
| 41 39 067 | 6/1993 | Germany . |
| 40 15 062 | 12/1993 | Germany . |
| 44 26 249 | 2/1996 | Germany . |

*Primary Examiner*—William Stryjewski
*Attorney, Agent, or Firm*—Herbert Dubno

[57] ABSTRACT

To produce a mock yarn which is similar in appearance to a true yarn with respect to the ability to discern the components of the mock yarn after the twist has been imparted to the mock yarn, the rovings or slubbings forming the mock yarn, after drafting separately but parallel to one another in a drafting frame, are subjected separately to condensing and compaction by suction rollers or belts provided with rows of perforations. Thus compacted and condensed rovings are then combined, twisted and wound up as mock yarns. A core thread can be introduced into each roving or into at least one of the rovings upstream of the last pair of drafting rolls or immediately upstream of the condensing unit for a core mock yarn.

12 Claims, 7 Drawing Sheets

METHOD OF AND APPARATUS FOR MAKING A MOCK YARN

FIELD OF THE INVENTION

Our present invention relates to a method of and an apparatus for the production of a mock yarn and, more particularly, to the fabrication of a mock yarn from two slubbings or rovings supplied by a drafting frame and to a spinning machine capable of producing such a mock yarn. The invention, more specifically, relates to a mock yarn in which the two rovings or slubbings are initially drafted in the drafting frame separately and in parallel to one another, are subjected to condensing or compacting, and are then combined and subjected to a common twist in a spinning machine.

BACKGROUND OF THE INVENTION

Condensing devices which are capable of compacting a roving, i.e. a collection of fibers with limited intrinsic twist, also referred to as slubbing, have made use of cylindrical rollers which are formed along their periphery with a row of perforations and flexible belts which likewise can have a row of perforations. A rotatable roller system of this type is described, for example, in German patent document DE 44 26 249 A1. A system using belts is described in EP 0 635 590 A2.

A "mock" yarn, as that term is used in the textile industry, can be a textile strand which is formed from two untwisted rovings or slubbings to which a common twist is imparted. In this operation, the two rovings are wound around one another and the thus resulting collection of filaments has a twist applied to it. A mock yarn of this type differs from a true yarn in that the two components of the mock yarn do not have their own twists. In a true yarn, each of the components can be significantly twisted or spun prior to joining of the spun threads into the yarn. When the two practically untwisted rovings or slubbings are wound around one another to have a common twist, this twist or spun character is observable in the finished product just as it is in true yarns.

In appearance, a mock yarn is similar to a true yarn although in the true yarn, the two components can be individually discernable in spite of the collective twist imparted whereas in a mock yarn, although the twist is visible, it is impossible to distinguish between the components which are twisted together. In the preparation of the mock yarn, therefore, efforts have been made to develop techniques which prevent too tight a twisting of the two components of the mock yarn together.

OBJECTS OF THE INVENTION

It is, therefore, the principal object of the present invention to provide an improved mock yarn whereby drawbacks of earlier techniques are avoided.

It is also an object of the invention to provide a mock yarn in which, while it is difficult to clearly discern the individual components, an excessively tight spinning is not required to make a comparatively strong product.

It is also an object of the invention to provide an improved apparatus for making a mock yarn.

Another object of this invention is to provide a spinning machine which is capable of producing a mock yarn of high quality.

SUMMARY OF THE INVENTION

These objects and others which will become apparent hereinafter are attained, in accordance with the invention in a method of making a mock yarn which comprises passing a pair of slubbings or rovings through a drafting frame and drafting or drawing the roving or slubbing in that drafting frame parallel to one another and side by side with one another and then subjecting these two ultimate components of the mock yarn to a condensation or compacting operation. The condensation utilizes, according to the invention, a pressing roller or belt having a row or track of perforations which are subjected to evacuation and which press against the respective rovings.

Because of this condensation, the fibers of each roving or slubbing at the output side of the drafting frame are gathered or compacted into a compact fiber strand which has fewer projecting fibers and then only relatively short projecting fibers so that, upon joining of the rovings with one another, the rovings tend to merge together to a lesser extent than rovings without such condensation or compaction. In other words there is less tendency for fibers of one roving to penetrate into and merge with fibers of the other roving when the two are twisted together. In spite of the fact, therefore, that the rovings do not have significant individual twist before combination into the mock yarn, therefore, they appear as separate elements of the mock yarn after the twist is imparted to the latter and thus because the components of the mock yarn remain clearly and individually discernable. The mock yarn of the invention thus has a closer appearance to a true yarn than earlier mock yarns.

The method of the invention can thus comprise the steps of:

(a) in a drafting frame, separately drafting a plurality of rovings in parallel to one another and next to one another;

(b) subjecting each of the separately drafted rovings to a condensing operation; and (c) thereafter combining the separately drafted and condensed rovings, twisting the combined rovings together to a mock yarn and winding up the mock yarn.

An apparatus for making a mock yarn according to the invention thus comprises a drafting frame of the type described in which two rovings or slubbings can be separately but in parallel to one another, drafted and fed to respective condenser or compaction units, downstream of which there is a device for twisting and winding up mock yarn resulting from the twisting operation.

The condensing or compacting devices can be provided at the outlet end of the drafting frame and engage the rovings after they have left the drafting frame and before they are combined to form the mock yarn.

In its apparatus aspects the spinning machine of the invention can comprise:

a drafting frame having a plurality of roller pairs in succession engaging and drafting respective rovings and including an output roller pair at which respective drafted individual rovings emerge from the drafting frame;

a condensing device for condensing the rovings emerging from the drafting frame and comprising at least one endless movable surface formed with at least one row of perforations under suction engageable with each of the rovings emerging from the drafting frame; and means downstream of the condensing device for combining condensed individual rovings, imparting twist to the combined condensed rovings to form and stabilize a mock yarn and winding up the mock yarn.

The drafting frame, the condensing devices and the system for twisting and winding up the mock yarn which is produced can be of various types.

For example, the method of the invention can be used to produce a core mock yarn and, in that case, means can be provided to introduce a core yarn, preferably upstream of the last pair of drafting rollers or downstream of that last pair of drafting rollers but upstream of the condensing or compaction devices. A core mock yarn is a mock yarn in which at least one of the rovings or components can contain a core thread. A core thread can also be introduced between the two components as they are combined to form the mock yarn. That core yarn, the core thread should be completely embedded in or surrounded by the rovings whose fibers should form the outer part of the mock yarn so that the core itself should not normally be visible. It will be understood that in conventional core yarns generally there are gaps in which the outer fibers do not completely surround or envelope the core and hence there are locations at which the core may be visible or is incompletely covered. The core yarn is then considered to be of poor quality.

By embedding the core yarns in the fibers of the rovings, the core can be concealed by the fibers of the roving even before the twist is imparted to the rovings around one another, thereby ensuring that there will be fewer gaps through which a core thread can be visible.

Since a single core thread may be used, that core thread may be introduced into only one of the rovings although for symmetry purposes it has been found to be desirable to introduce into each roving a respective core thread if a core yarn is desired.

So that the roving will not be dislocated upon leaving the drafting frame before it reaches the suction roller or the passage of the rovings onto the respective suction rollers of the condensing device will not be adversely affected by other disturbances like stray air streams or jets, it has been found to be advantageous to pass the rovings between the suction rollers and respective counterrollers, i.e. rollers disposed below the suction rollers. To support the rovings, moreover, a suction belt may bridge between the rollers of the condensing unit and the output rollers of the drafting frame. In this case, the belt may run from the roller of the condensing unit to a guide close to the nip of the output rollers of the drafting frame. The belt then supports the rovings in the gap between the condensing rollers and the drafting frame output rollers.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
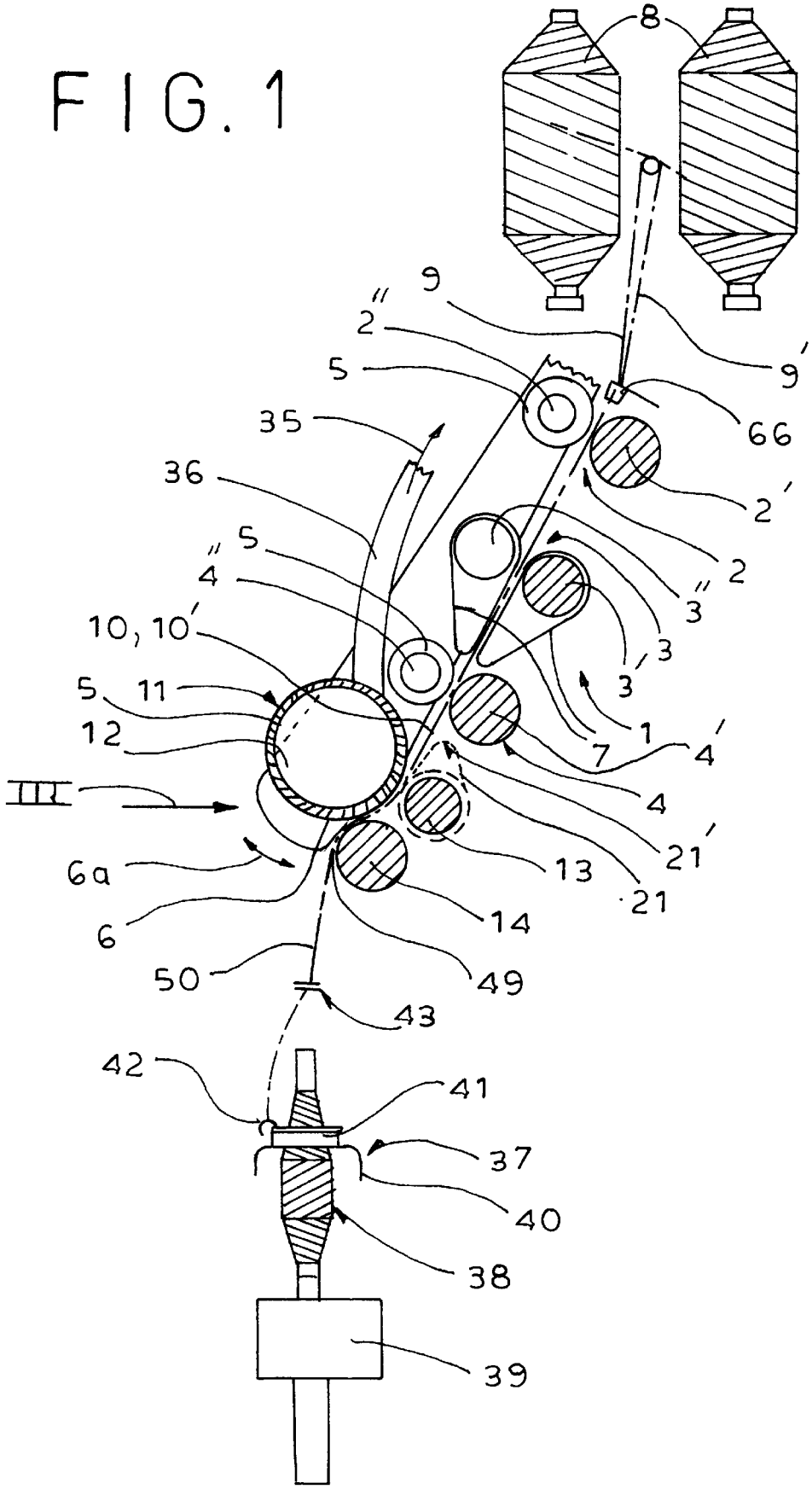
FIG. 1 is a transverse section through a drafting frame and a row of spindles of the spinning machine illustrating a first embodiment of the invention.

The spinning machine of FIG. 1 comprises a drafting frame 1 having a pair of inlet rollers 2, a middle roller pair 3 and an output roller pair 4. The lower rollers 2', 3' and 4' of the roller pairs 2, 3, 4 are steel rollers extending over the entire length of the drafting frame part of the spinning machine and cooperate with upper rollers 2", 3" and 4", each of which is provided as a twin upper roller.

In the region of the upper rollers 2", 3" and 4", the respective lower rollers may be milled or knurled. The upper rollers can have elastic jackets 5 and can be journaled and spring-loaded in a weighting upper arm 6 which assists in pressing the upper rollers against the lower rollers. The rods which mount the upper rollers in the weighted arm 6 have not been shown. The rollers 3' and 3" of the middle roller pair 3 can be equipped with belts 7 which are guided on the arm 6 and on the stand of the drafting frame on respective belt cages. Other drafting frame configurations can be used as well. The arm 6 may, of course, be swung as represented by the row 6*a* in FIG. 1 to afford access to the roving path between the upper and lower rollers.

For production of the mock yarn, each station of the drafting frame 1 can draw roving 9,9' or two separate roving bobbins 8 or a double roving can be drawn from a single bobbin, the rovings being passed through the drafting frame separately and in parallel. At each station of the drafting frame the two rovings are drawn to their respective final finenesses without being twisted individually either before drafting or during the drafting operation.

According to the invention at each station of the drafting frame 1 a respective condensing device 11 is provided for compacting two rovings or slubbings 10, 10' drafted in the drafting unit for each mock yarn. The configuration of the condenser unit can be varied. Only one possible embodiment of the condenser unit has been shown and it is noted that the invention need not be limited to this particular embodiment. As can be seen from FIGS. 1–3, the condenser unit 11 can have, above the path of the rovings or slubbings 10, 10', i.e. above the stretching field plane of the drafting frame, an upper roller 12 which may, as seen in FIG. 3, be formed as a twin roller. Each upper roller 12 bears on two lower rollers 13 and 14 which, like the lower rollers 2'3', 4' of the drafting frame, extend the full length of the spinning machine. The rollers 13 and 14 can be provided with milled or knurled portions such as those shown at 14*a* in FIG. 3.

Whether the rollers 12 are provided as single rollers or as parts of twin rollers, they can be journaled via their shafts 15 in the arm 6 of the drafting frame at the respective station and biased by the weight of that arm against the rovings 10 and 10' and the knurled portion 14*a* of the rollers 13 and 14.

The upper roller 12 is formed as a condenser and suction roller and for this purpose is provided along its periphery (see FIGS. 2 and 3) with circumferential rows of small suction openings 17. At least in the region between the rollers 13 and 14, a suction pipe 36 can open into each roller 12 to form a suction chamber 19 enclosed in part by a shield 18 which limits the suction zone 20 to a portion of the periphery between the rollers 13 and 14.

The circumferential length of the suction zone 20 can be about one half the staple length of the fibers to be processed or greater. The shield 18 and the open end of the suction pipe 36 can be mounted on the fixed shaft 15, i.e. upon the shaft on which the rollers 12 is rotatable.

To avoid an undesired breakage of the roving as it passes from between the output roller pair 4 to the suction roller 12, in the case of involuntary shutdown or interruption of the suction at the periphery of the suction roller 12 or upon the incursion of an air blast into the system, the lower roller 13 can be provided with a transport belt 21 which has its direction change rail 21' close to the nip of the roller pair 24 so that this transport belt 21 supports the rovings 10 and 10' to limit their breakage.

The next lower roller 14 met by the rovings 10 and 10' can be provided with milling as has been described and can be spaced from the roller 13 by a distance equal to or less than the main staple length and for processing staple fibers can have a circumference which corresponds to the mean stable length of the fibers processed. The circumference can correspond, in the case of cotton fibers to a diameter of 27 mm to 32 mm.

The suction roller 12 is usually composed of steel to avoid a metallic contact between its periphery and the lower rollers 13 and 14 which can also be composed of steel, which can give rise to wear, noise and slip, either the suction roller or the lower roller 14 can be provided with an elastic liner 5. In the embodiment shown in FIGS. 1 and 3, the suction roller 12 has the elastic jacket 5 and in the embodiment of FIG. 2, the lower rollers 13 and 14 are provided with elastic jackets 5.

Figure 3:
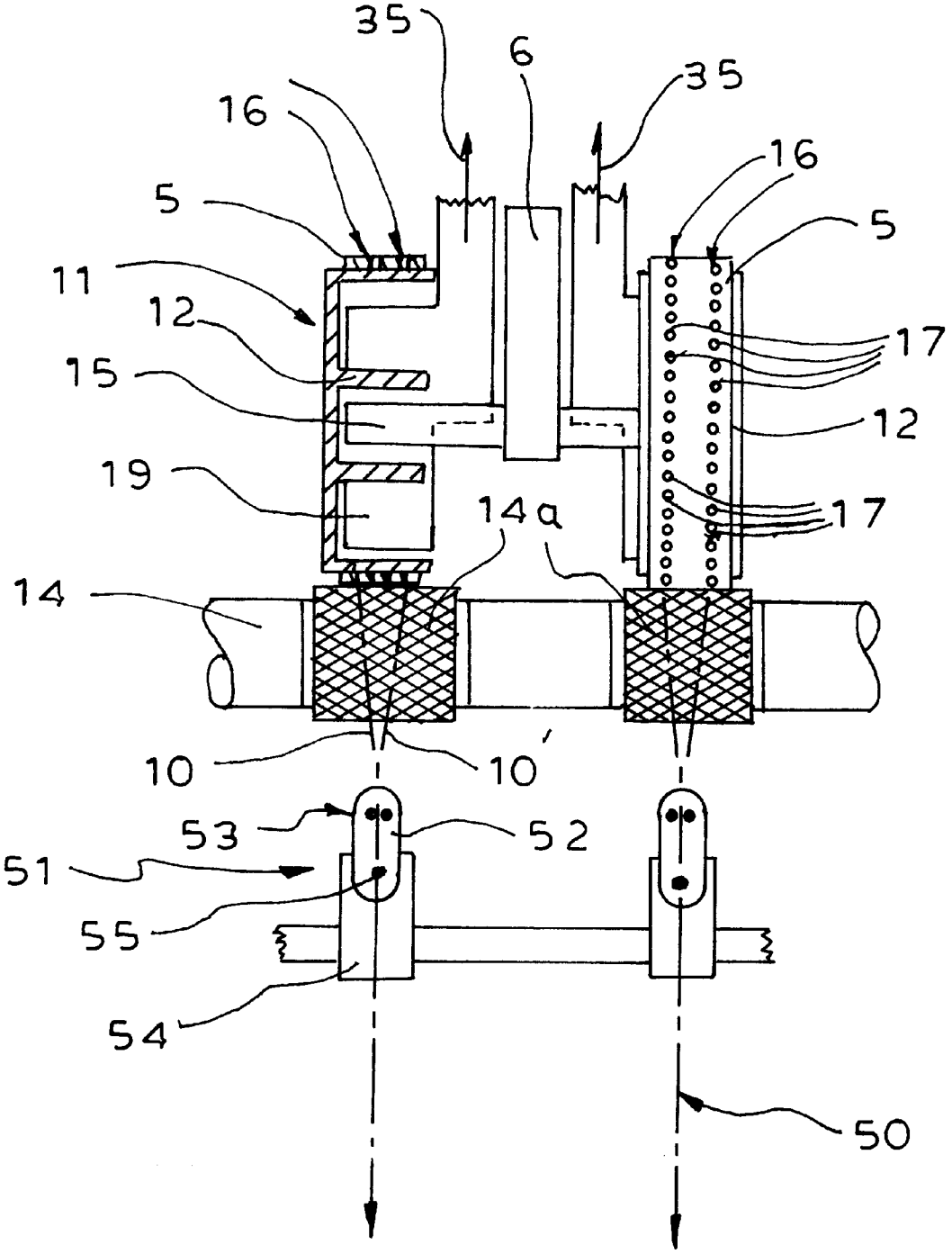
FIG. 3 is an elevational view of the condensing device of FIG. 1 as seen in the direction of arrow III of FIG. 1, partly broken away.
Figure 4:
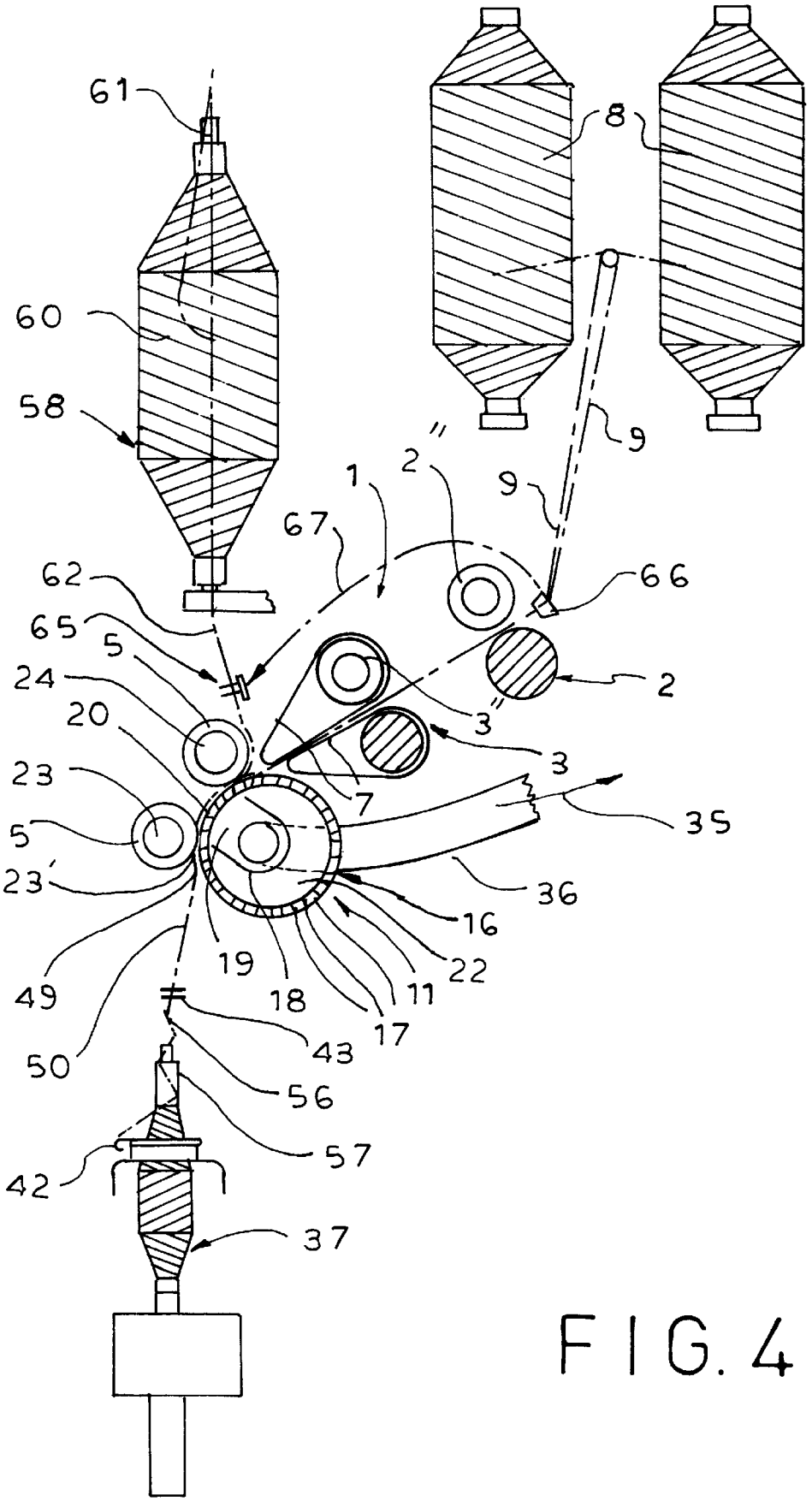
FIG. 4 is a view similar to that of FIG. 1 showing the production of a mock yarn with a core (i.e. a core mock yarn) with balloonless spinning.

FIG. 4 illustrates an embodiment in which the suction roller 22 which corresponds to the suction roller 12 in FIGS. 1–3 as to its construction, can be disposed beneath the path of the rovings 10, 10',i.e. below the stretch field plane of the drafting frame. At least one, but preferably 2, upper rollers 23 (and 24) can be provided in juxtaposition with the roller 22. The upper roller 23 is located at the end of the condensing zone 20 delimited by the suction chamber 19 and grips the combined rovings at a nip 23' to form a twist stop for the twist imparted to the rovings downstream of the suction roller 22.

This embodiment represents a modification of the arrangement shown in FIG. 1 also in that, in the drafting frame itself, a special output roller pair of the drafting frame is eliminated and the output of the drafting frame is in effect formed by the suction roller 22 and a further upper roller 24 located at the beginning of the condensing zone.

In other words the drafting frame in the embodiment of FIG. 4 comprises the inlet roller pair 2 and the intermediate roller pair 3, the latter having the belts 7 as previously described. The upper rollers 2", 3", 24 and 25 may all be carried by an arm as shown at 8 while the lower rollers 2 and 3 may be throughgoing on the drafting frame and individual suction rollers 22 or pairs suction rollers can be mounted on the machine frame.

Figure 5:
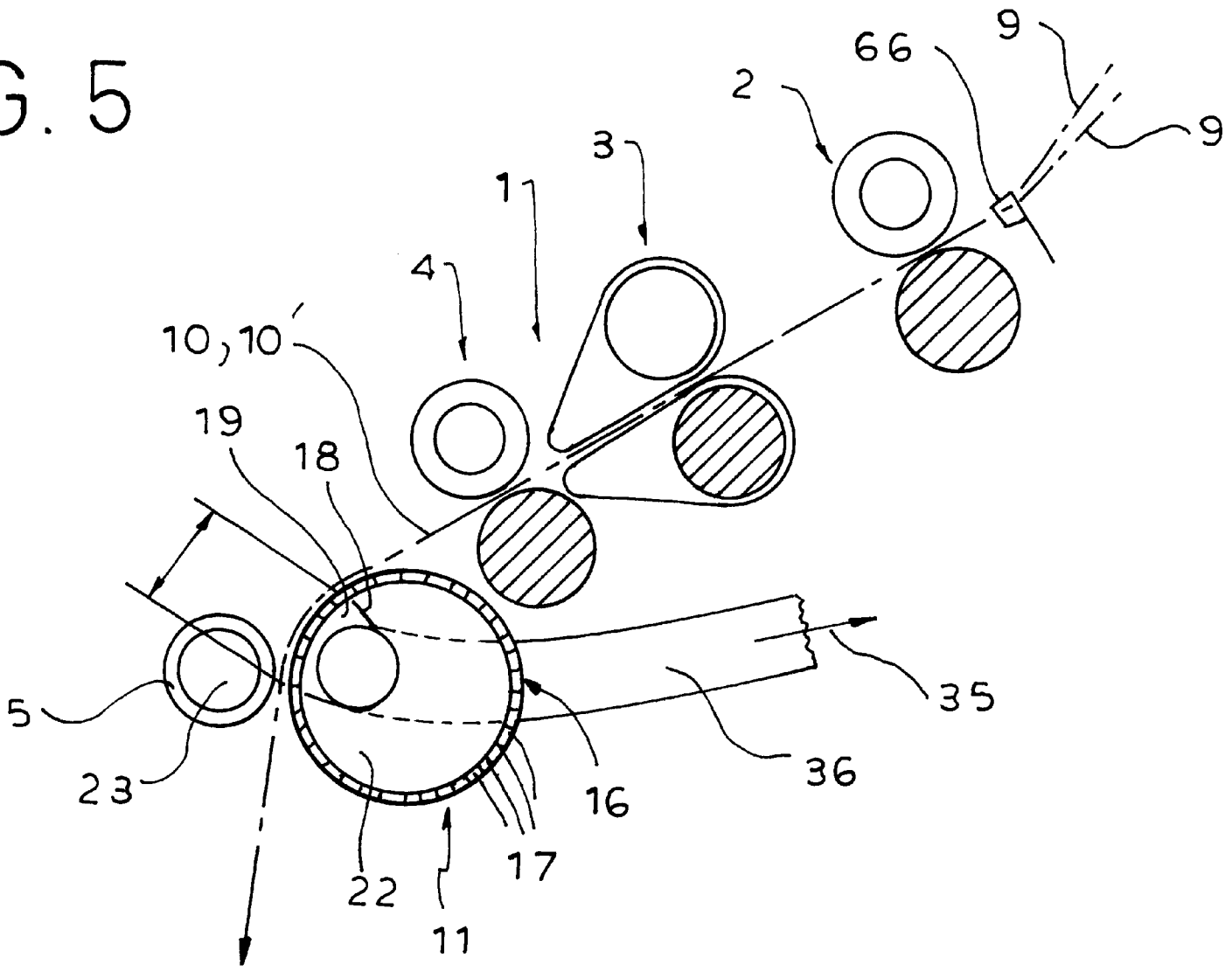
FIG. 5 is a cross sectional view through the drafting unit and condensing device of a system representing a variation on that of FIG. 4.

FIG. 5 shows an embodiment of the invention in the region of the drafting frame in which the condensing unit 11 is modified from the configuration shown in FIG. 4 by having the complete drafting frame with the roller pairs 2, 3 and 4 of FIG. 1, and the suction roller 22 with its counter-roller 23. Here the additional upper roller 24 which delimited the upstream side of the condensing zone 22 and is present in the embodiment of FIG. 4 has been eliminated.

In the embodiment of FIG. 4, a core yarn 62 withdrawn from a core yarn supply 58 and a bobbin 60 through the inner tube 61 supporting the bobbin 60, can be fed around the upstream roller 24 to the condensing zone 20. In both embodiments the roving funnels 66 can be provided at the inlets of the roving path.

Figure 6:
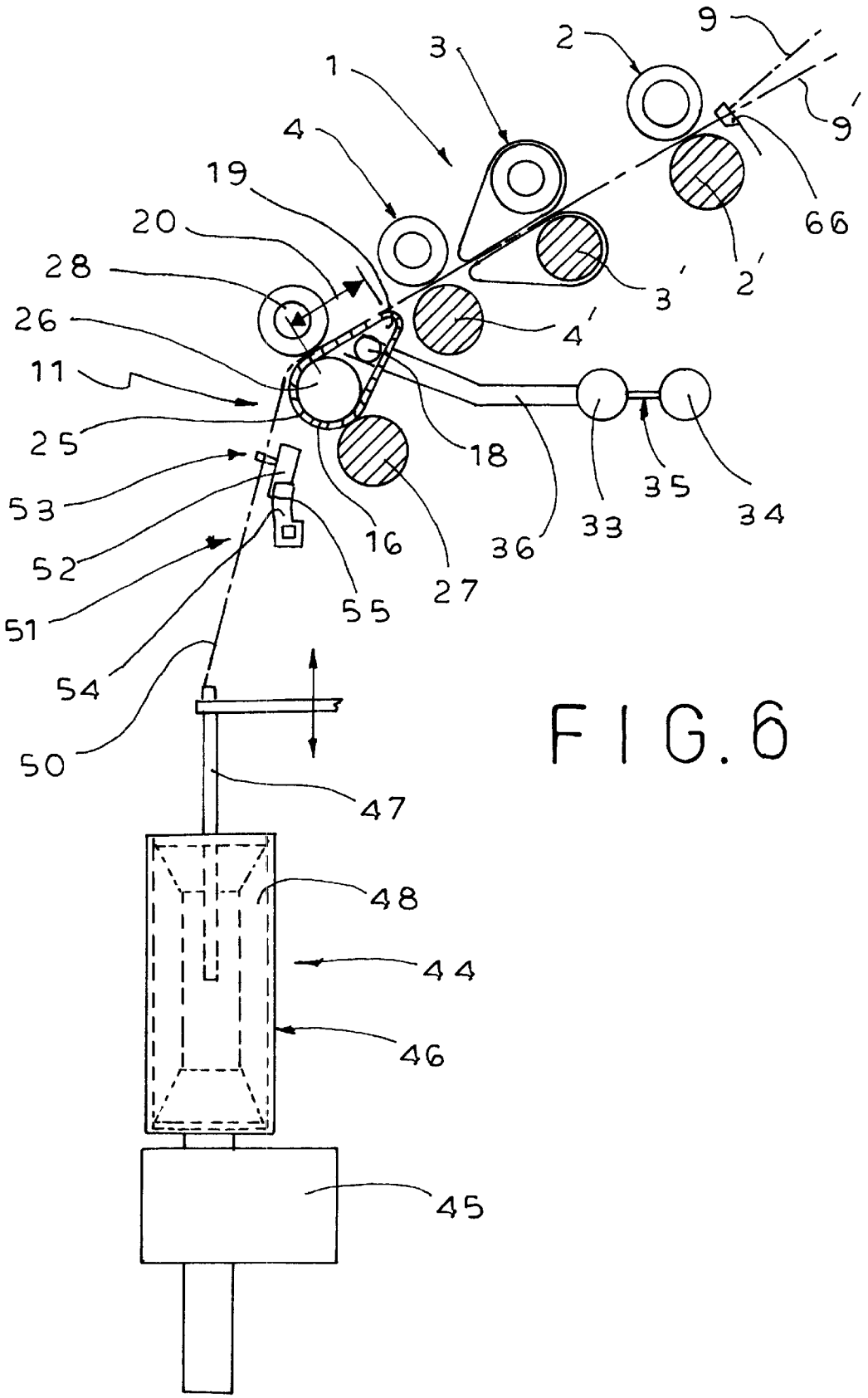
FIG. 6 is another view of an apparatus for producing a mock yarn according to the invention.

In the embodiment of FIG. 6, the condensing unit 11 utilized a suction belt 25 of an elastic synthetic resin material and which is provided with perforations in rows 16 like those of the suction rollers or drums 12 and 22. The perforations can be in the form of small suction orifices 17 which communicate with the inlet of a suction pipe opening into the shield 18 which defines a suction chamber 19 extending over a suction zone 20 upstream of a roller 28 juxtaposed with the belt 25. The latter passes over a roller 26.

The suction belt 25 is looped both around this roller 26 and a the shield 18 and is driven by a fiction roller 27 which, like the rollers 2', 3' and 4' can extend the full length of the drafting frame of the spinning machine and is a continuous steel roller. Each upper roller 28 of the respective belt roller 26 forms a roller pair whose nip serves to limit the twist of the mock yarn 50. The suction belt supporting the lower roller 26 and the upper roller 28 of a particular station may each be twin rollers as has been shown at 12 in FIG. 3. The upper roller 28 can be formed with an elastic jacket 5 and can otherwise have a steel core. The belt 25, as noted, is likewise an elastic material and can be provided with steel reinforcement and the roller 26 can be a steel roller. The belt rollers 26 are preferably twinned rollers, thereby facilitating replacement of the belts 25 upon wear thereof.

Figure 7:
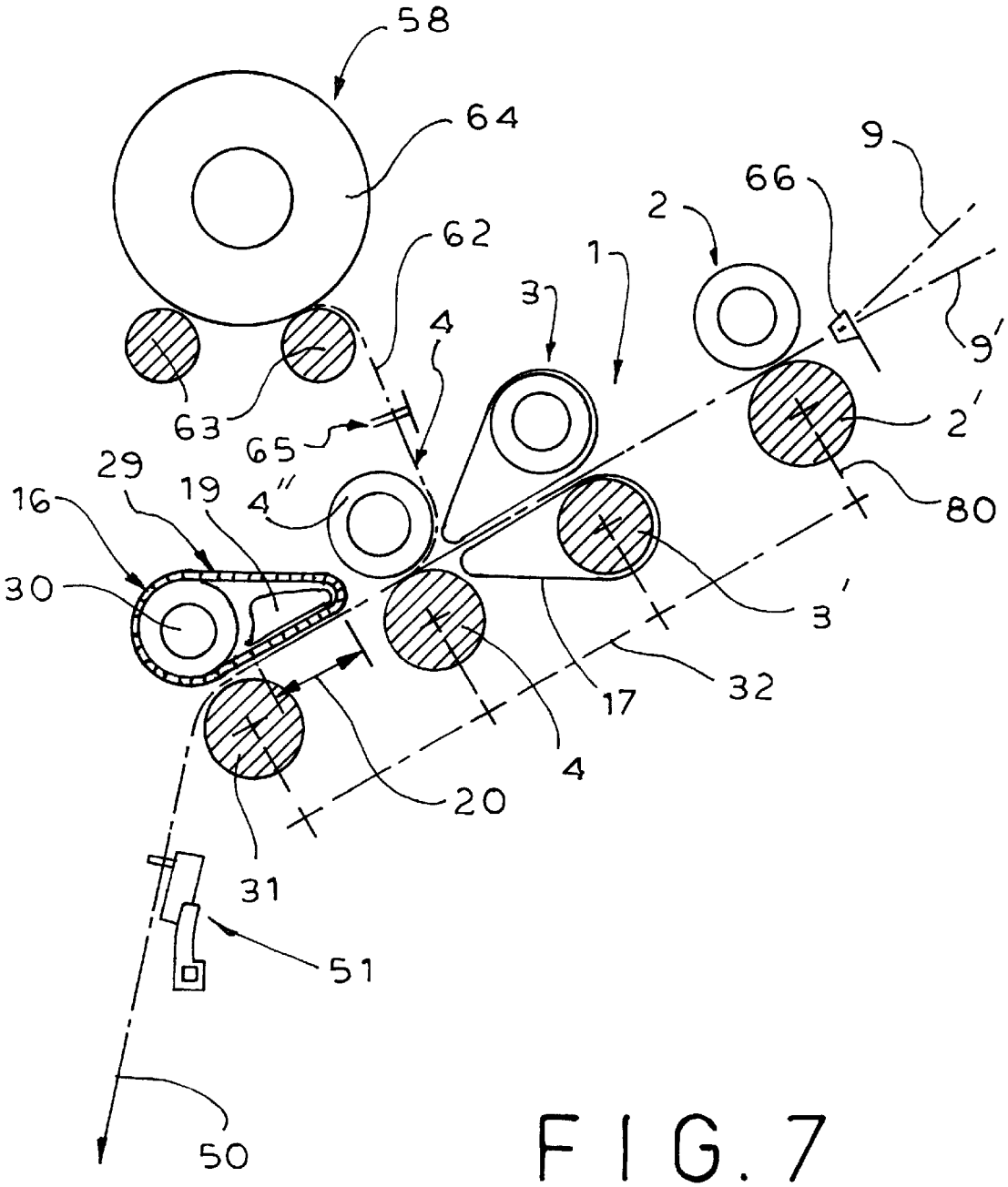
FIG. 7 shows, in transverse section, a further embodiment of a spinning machine for producing a core mock yarn.

FIG. 7 shows a further modification in which downstream of a drafting frame 1 of the type shown in FIG. 1, having an inlet roller pair 2, an intermediate roller pair with respective belts 7 and an outlet roller pair 4, a suction belt arrangement 29 is provided on the arm (not shown) of the drafting frame. Here the belt 29 runs about an upper roller 30 which is juxtaposed with the steel lower roller 31 which, like the rollers 2', 3' and 4' are mounted on the support 80 of the drafting frame over the entire length thereof. The condensing zone 20 is here formed along the underside of the belt 29 and is defined by the suction chamber 19 which can be evaluated through a tube 36 as previously described. The core yarn 62 is led to the rovings 9, 9' in the drafting frame around the upper roller 4".

Figure 2:
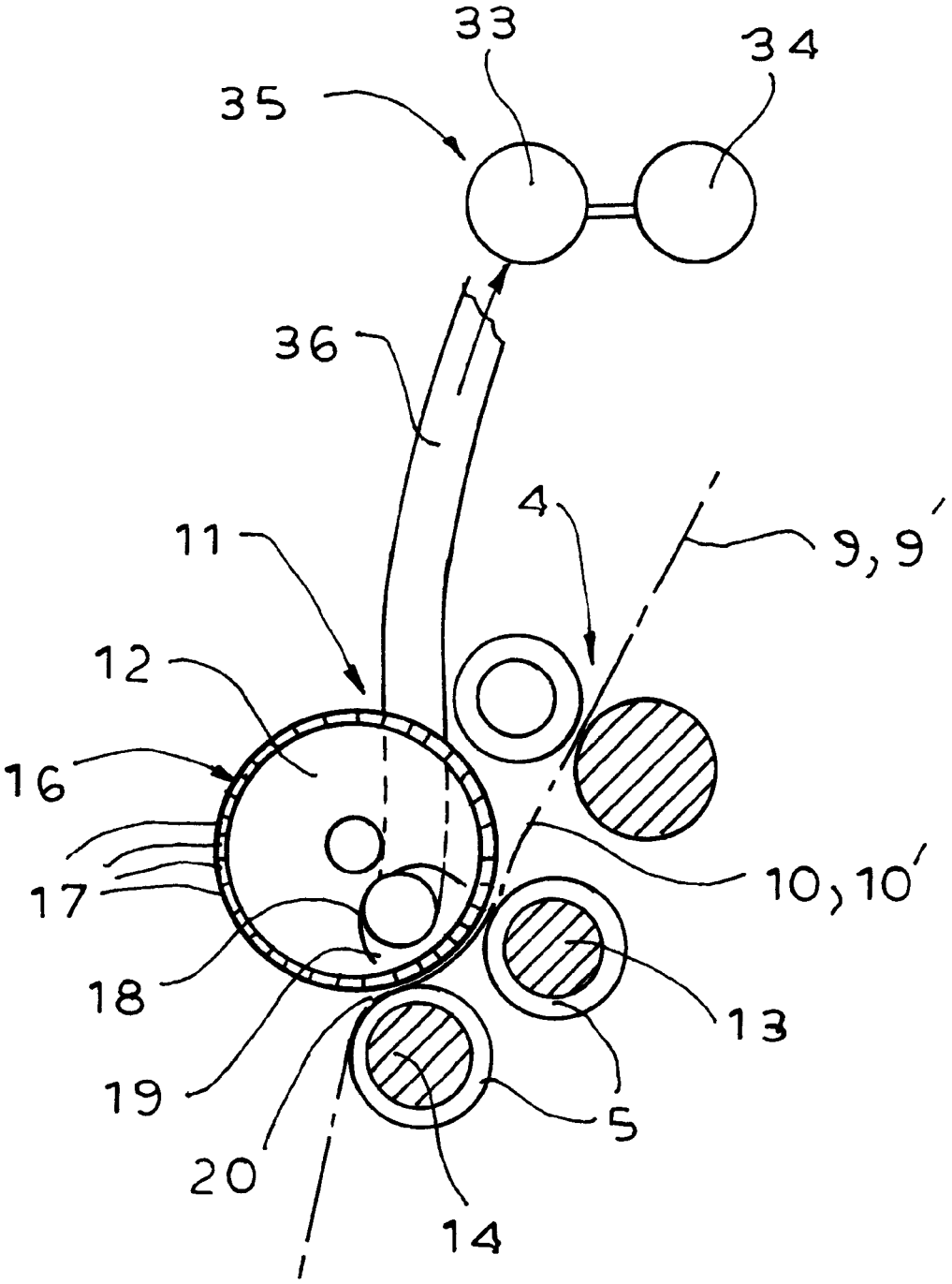
FIG. 2 is a partial section through the outlet side of the drafting frame and the roving condenser unit representing a variation in the system of FIG. 1.

The application of suction to the suction chambers 19 of the various embodiments has only been indicated diagrammatically in FIGS. 2 and 6 and can be achieved via a suction pump 33 driven by a motor 34 and constituting the suction source represented at 35 which is connected to the hose or pipe 36.

The condensing unit 11 can be provided immediately upstream of a conventional ring spinning station of the spinning machine (FIGS. 1 and 4) which can include at each station a spinning spindle 38 on a spindle rail 39, a ring rail 40 which is vertically movable along the bobbin which is wound up on the spindle, a spinning ring 41 and the rail 40 and a traveler 42 orbiting the bobbin on the ring 41. A thread guide 43 is provided downstream of the nip between the rollers 12 and 14 in the embodiment of FIG. 1 and between the rollers 22 and 23 in the embodiment of FIG. 4 and the thread guide eye 43.

Instead of a ring-spinning station, we can make use of a pot spinning machine structure 47 having a pot rail 45 on which the spinning pots 26 are mounted and are driven. Within the spinning pot 46, by up and down movement of a thread guide tube 47, the spun yarn is deposited at 48 in a spinning cake.

In operation the drafting frame 1 delivers at the output roller pair two parallel, drafted and individual rovings 10 and 10' which, as a consequence of the diameter of the supplied sliver 9, 9' and the drafting effect, each is a band of a certain width. Because of the suction applied at the suction rollers or belts of the condensing unit (see elements 12 and 22 in FIGS. 1, 2 and 4) and the suction belts 25 and 29 (FIGS. 4 and 5), the fibers which extend sideways in the rovings 10 and 10' are drawn into line with the suction openings or perforations 17 and the rovings are thereby compacted. In their compacted states, the rovings are supplied to the ring-spinning stations 37 or to the pot-spinning stations 44 and are joined together at a combining point 49 to the mock yarn 50, stabilized by twisting around one another and are wound up on the respective yarn package.

In order to prevent continued travel of the yarn in the case of a rupture of one of its components 10 or 10' as a simple yarn, a yarn breaker 51 can be provided which, upon breakage of any component will result in breakage of the other component or complete rupture of the yarn so that further travel to the yarn package is terminated. Such a yarn breaker has been shown in FIGS. 3, 6 and 7 and can include a latch 52 with a pair of pins 53 between which the mock yarn 50 runs. The latch 52 is mounted on an outrigger 54 having a small stable range and is tiltable about a pivot axis 55. When one of the components of the yarn breaks, the other component swings the catch 52 out of its stable range so that the catch 52 swings down and the pin 53 then engaging the traveling yarn can rupture it. The remaining component about to be ruptured, loops around one of the pins 53 and is torn by further travel of the wound-up yarn.

In the embodiment of FIG. 4 the spinning spindle 38 is part of a ring-spinning system but has a spinning finger 56 which forms a guide for the mock yarn onto the package so that the spinning finger 56 will capture the mock yarn close to the guide eye 43 and wrap the yarn around the spinning tube or sleeve 57, thereby eliminating a thread balloon between the eye 43 and the traveler 42. Instead of a spinning finger, a spinning crown can provide a similar effect.

The method and apparatus of the invention can be utilized to great advantage in the production of a core mock yarn. In this case, a core thread can be supplied to each of the two roving components of the mock yarn or a single core yarn can be provided to the combined rovings. The core yarn can provide strength and elasticity and both strength and elasticity can be gained when even only one core yarn is introduced. In the embodiment of FIGS. 4 and 7, a core yarn is fed from the bobbin 60 from the core yarn station 58 for the production of a core mock yarn at 50. Of course two such core yarn bobbins may be provided when two core yarns are to be incorporated in the mock yarn.

The or each core yarn bobbin 60 can be mounted upon a respective support tube 61 from which the core yarn 62 is supplied to the upper roller 24 at the beginning of the condensing zone 20. The withdrawal of the core yarn 62 from its bobbin 60 is effected by the tension applied in the nip between the upper roller 24 and the suction roller 22.

In FIG. 7, the drafting frame 1 is shown to receive a core yarn 62 which is delivered by a yarn package 64 resting on a pair of rollers 64 extending parallel to the rollers 2', 3', 4' and 31 over the length of the drafting frame. Two or more core yarn spools 64 can be provided and the respective yarns can be delivered at the upstream side of the upper roller 4" of the output roller pair 4. The rollers 63 can be driven with the peripheral speed required as the feed speed for the core yarn. The result is that the core yarn 62 meets the rovings 10, 10' at the speed with which they are delivered by the output rollers 4 from the drafting frame. The ability of the suction unit 12, 22, 25 and 29 to draw the fibers laterally via the perforations on the rovings 10, 10' is limited. By and large the rovings 10, 10' do not shift laterally back and forth during the operation or shift in such manner only to a small degree.

As a consequence each core yarn 62 will always be fed centrally to one of the rovings 10, 10'. To achieve this, in spite of the fact that the core yarn is wound on the spool 64, for example with a back and forth pattern, the core yarn 62 must be guided by a thread guide 65 which is capable of neutralizing the back and forth pattern of movement of the core yarn and of centering the core yarn to the rovings 10, 10'. The sliver inlet funnels 66, of course, center the respective slivers 9, 9' on the paths of the drafting frame. All of these positions must be set for proper travel of the rovings and, when a back and forth movement is effected by the rovings, the funnels 66 and the core yarn guide 65 must be mechanically coupled so that their movements follow one another as has been shown by the dot-dash line 67 in FIG. 4.

It will be apparent that in the embodiment of FIG. 7 as well the core yarn or core yarns can be fed to the rovings at the beginning of the condensing operation, i.e. at the upstream end of the condensing zone 20 and hence directly to the belts 29.

While various arrangements of drafting frame, condensing devices, spinning, twisting and wind-up systems and ring-spinning and pot-spinning and coreless or core yarn arrangements have been described, they may be used in substantially any combination in accordance with the principles of the invention.

We claim:

1. A spinning machine for producing a mock yarn, comprising:

a drafting frame having a plurality of roller pairs in succession engaging and drafting respective rovings and including an output roller pair at which respective drafted individual untwisted rovings emerge from said drafting frame;

a condensing device for condensing the untwisted rovings emerging from the drafting frame and comprising at least one endless movable surface formed with a single row of perforations under suction engageable with each of said untwisted rovings emerging from the drafting frame; and means downstream of said condensing device for combining condensed individual untwisted rovings, imparting twist to the combined condensed untwisted rovings to form and stabilize a mock yarn and winding up said mock yarn.

2. The spinning machine defined in claim 1 wherein said surfaces are peripheries of respective rollers formed with said rows of perforations.

3. The spinning machine defined in claim 2 wherein said surfaces are formed as the peripheries of respective upper rollers, said condensing device further comprising at least one lower roller, each upper roller pressing a respective roving against a lower roller, said lower rollers being driven.

4. The spinning machine defined in claim 1 wherein said surfaces are formed by belts each having at least one of said rows of perforations.

5. The spinning machine defined in claim 1 wherein said means downstream of said condensing device for combining condensed individual rovings includes a spinning station for low thread balloon spinning of said mock yarn.

6. The spinning machine defined in claim 1 wherein said means downstream of said condensing device for combining condensed individual rovings includes a spinning station for a balloonless spinning of said mock yarn.

7. The spinning machine defined in claim 1, further comprising means for breaking the mock yarn to be wound up upon rupture of one of said rovings.

8. A spinning machine for producing a mock yarn, comprising:

a drafting frame having a plurality of roller pairs in succession engaging and drafting respective rovings and including an output roller pair at which respective drafted individual rovings emerge from said drafting frame;

a condensing device for condensing the rovings emerging from the drafting frame and comprising at least one endless movable surface formed with a single row of perforations under suction engageable with each of said rovings emerging from the drafting frame; and means downstream of said condensing device for combining condensed individual rovings, imparting twist to the combined condensed rovings to form and stabilize a mock yarn and winding up said mock yarn, said means downstream of said condensing device for combining condensed individual rovings including a spinning station for low thread balloon spinning of said mock yarn, said spinning station being formed with a finger for guiding said mock yarn onto a yarn package without a thread balloon.

9. A spinning machine for producing a mock yarn, comprising:

a drafting frame having a plurality of roller pairs in succession engaging and drafting respective rovings and including an output roller pair at which respective drafted individual rovings emerge from said drafting frame;

a condensing device for condensing the rovings emerging from the drafting frame and comprising at least one endless movable surface formed with a single row of perforations under suction engageable with each of said rovings emerging from the drafting frame; and means downstream of said condensing device for combining condensed individual rovings, imparting twist to the combined condensed rovings to form and stabilize a mock yarn and winding up said mock yarn, said means downstream of said condensing device for combining condensed individual rovings including a spinning station for low thread balloon spinning of said mock yarn, said spinning station being a pot spinner.

10. A spinning machine for producing a mock yarn, comprising:

a drafting frame having a plurality of roller pairs in succession engaging and drafting respective rovings and including an output roller pair at which respective drafted individual rovings emerge from said drafting frame;

a condensing device for condensing the rovings emerging from the drafting frame and comprising at least one endless movable surface formed with a single row of perforations under suction engageable with each of said rovings emerging from the drafting frame;

means downstream of said condensing device for combining condensed individual rovings, imparting twist to the combined condensed rovings to form and stabilize a mock yarn and winding up said mock yarn, said means downstream of said condensing device for combining condensed individual rovings including a spinning station for low thread balloon spinning of said mock yarn; and means for feeding a core yarn to said rovings.

11. The spinning machine defined in claim 10 wherein said means for feeding said core yarn to said rovings delivers said core yarn to said drafting frame upstream of said output roller pair.

12. The spinning machine defined in claim 10 wherein said means for feeding said core yarn to said rovings delivers said core yarn to said condensing device.

* * * * *